US008021252B2

(12) United States Patent
Goedoen

(10) Patent No.: US 8,021,252 B2
(45) Date of Patent: Sep. 20, 2011

(54) SPORTS BALL WITH A WOVEN FABRIC AND METHOD FOR MANUFACTURING SUCH A SPORTS BALL

(75) Inventor: Auranga Ajanta Goedoen, Amsterdam (NL)

(73) Assignee: Geodoen Holding FZC, Sharjah (AE)

( * ) Notice: Subject to any disclaimer, the term of this patent is extended or adjusted under 35 U.S.C. 154(b) by 71 days.

(21) Appl. No.: 11/291,819

(22) Filed: Dec. 2, 2005

(65) Prior Publication Data

US 2006/0229149 A1 Oct. 12, 2006

(30) Foreign Application Priority Data

Apr. 8, 2005 (EP) ..... 05102788
Apr. 18, 2005 (EP) ..... 05103087

(51) Int. Cl.
*A63B 41/10* (2006.01)
*A63B 37/12* (2006.01)

(52) U.S. Cl. ..... 473/604; 473/600

(58) Field of Classification Search ..... 473/604–606, 473/598, 600–602
See application file for complete search history.

(56) References Cited

U.S. PATENT DOCUMENTS

| | | | | | |
|---|---|---|---|---|---|
| 2,579,294 | A * | 12/1951 | Brown | 473/605 |
| 4,462,590 | A * | 7/1984 | Mitchell | 473/603 |
| 4,660,831 | A * | 4/1987 | Kralik | 473/603 |
| 4,834,382 | A * | 5/1989 | Spector | 473/603 |
| 4,944,363 | A * | 7/1990 | Osher et al. | 473/601 |
| 5,035,426 | A * | 7/1991 | Spector | 473/599 |
| 5,310,178 | A | 5/1994 | Walker et al. | |
| 5,320,345 | A * | 6/1994 | Lai et al. | 473/601 |
| 5,335,907 | A * | 8/1994 | Spector | 473/594 |
| 5,405,469 | A * | 4/1995 | Lin | 473/614 |
| 5,413,331 | A | 5/1995 | Stillinger | |
| 5,462,273 | A * | 10/1995 | Spector | 473/594 |
| 5,522,757 | A * | 6/1996 | Ostrowski | 473/599 |
| 5,772,545 | A * | 6/1998 | Ou | 473/605 |
| 5,997,422 | A * | 12/1999 | Cooper | 473/599 |
| 6,220,079 | B1 | 4/2001 | Taylor et al. | |
| 6,348,018 | B1 * | 2/2002 | Ou | 473/604 |
| 6,431,942 | B1 * | 8/2002 | Krull | 473/614 |
| 6,971,965 | B1 * | 12/2005 | Shishido | 473/604 |
| 2005/0277499 | A1 * | 12/2005 | Tang et al. | 473/604 |
| 2006/0046880 | A1 * | 3/2006 | Tang et al. | 473/604 |

FOREIGN PATENT DOCUMENTS

| | | |
|---|---|---|
| JP | A 06-315546 | 11/1994 |
| JP | A 09-000659 | 1/1997 |
| RU | 2 232 616 C1 | 7/2004 |
| SU | 1743623 A1 | 6/1992 |
| WO | WO 2005/087326 A1 | 9/2005 |
| WO | WO 2006/021140 A1 | 3/2006 |

* cited by examiner

*Primary Examiner* — Steven Wong
(74) *Attorney, Agent, or Firm* — Oliff & Berridge, PLC

(57) ABSTRACT

The invention relates to a sports ball (1) comprising a core (2) and a cover (3) formed from a plurality of panel segments (4). One or more of said panel segments have an outer face covered with a woven fabric (7), preferably denim. The panel segments are connected at joints (6) and said woven fabric is attached to said outer face at said joints. The invention further relates to a method for manufacturing a sports ball.

14 Claims, 4 Drawing Sheets

SPORTS BALL WITH A WOVEN FABRIC AND METHOD FOR MANUFACTURING SUCH A SPORTS BALL

The invention relates to a sports ball, such as a soccer ball, a baseball, an American football or rugby ball and a basketball, comprising a core and a cover formed by a plurality of panel segments.

The interest in sports has dramatically increased over the years and people are becoming more aware of the advantageous implications sports exercise has for their health. Lots of schools and parks have playgrounds for e.g. soccer, baseball and basketball.

These sports involve balls, such as soccer balls, baseballs and basketballs. Balls vary in design and construction. Balls in various materials, types, size and weights are available.

A considerable degree of technological development in the field of sports balls can be observed. As an example, JP09-000659 discloses a basket ball having a fabric panel of denim as a surface layer that is bonded by an adhesive layer to the surface of a main body containing compressed air. The denim surface layer improves the grip on the basketball, is high in durability and is nice to touch.

It is an object of the invention to provide an improved ball, preferably a sports ball, with adequate grip and durability properties.

This object is accomplished by a sports ball comprising a core and a cover formed from a plurality of panel segments, one or more of said panel segments having an outer face covered with a woven fabric, preferably denim, wherein said panel segments are connected at joints and said woven fabric is attached to said outer face at said joints.

By attaching the woven fabric or woven fabric segments, preferably denim or canvas, to the outer surface of the panel segments at the connection joints (and preferably solely at these joints) the fabric may be attached in a more simple manner to the panel segments. Attachment of the fabric at the joints to the outer surface of the panel segments guarantees adequate attachment of the fabric, while an adhesive layer is not necessary. Although wear of the woven fabric occurs, this wear provides an appearance to the ball which is comparable to e.g. stonewashed jeans. This appearance is perceived as attractive in particular circles. Accordingly, the choice of a denim outer layer results in that use of the sports ball enhances the value of the ball.

It should be noted that the core of the sports ball may e.g. involve a bladder for holding air and one or more linings placed between the cover and the bladder.

For balls with stitched covers, such as soccer balls, baseballs and rugby balls, the fabric is preferably attached to the outer surface by the stitches of the panel segments.

For balls with thermally moulded covers, such as basketballs, the fabric is preferably attached to the outer surface by the thermally moulded joints.

An advantageous property of the woven fabric pertains to the possibility to mark this fabric with signs or logos, such as texts or graphics, contributing to the appearance of the ball. These signs may be either printed or painted on, sewn to, embroidered in or otherwise provided on the fabric.

To prevent absorption by the woven fabric of e.g. water, a transparent water impermeable coating may be provided over the woven fabric. Such a transparent outer coating may e.g. include a transparent rubber coating, a transparent polyvinyl chloride coating (PVC) coating and/or another type of transparent vinyl coating. The coating is preferably attached to the woven fabric. It should be acknowledged that the woven fabric, e.g. denim or canvas, provided with a transparent coating may also be applied for other articles than the sports ball of the invention, including a ball with a denim cover, an umbrella of a woven fabric, a cover for a seat, or a car roof of e.g. a convertible.

The invention also relates to a method for manufacturing a sports ball as described above, comprising the step of sewing said panel segments together to form said joints substantially simultaneously with attaching said woven fabric at said joints. This method may involve hand-sewing or machine-sewing.

The invention also relates to a method for manufacturing a sports ball as described above, comprising the step of thermally moulding said panel segments together to form said joints substantially simultaneously with attaching said woven fabric at said joints.

The balls manufactured according to these methods have an adequately attached woven fabric, while the attachment processing is combined with the connection processing of the panel segments.

The invention will be further illustrated with reference to the attached drawings, which schematically show preferred embodiments according to the invention. It will be understood that the invention is not in any way restricted to these specific and preferred embodiments.

Figure 1B:
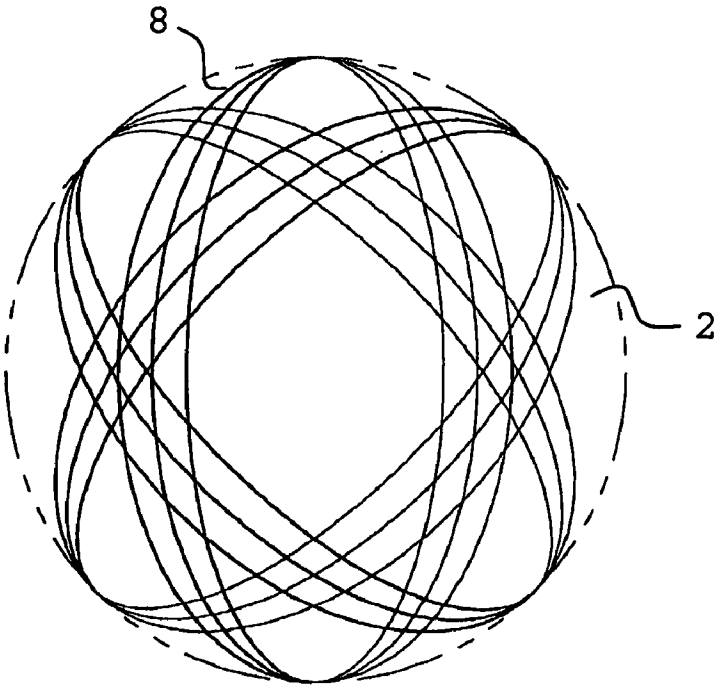
FIGS. 1A and 1B show a soccer ball with a partial cutaway and a bladder according to an embodiment of the invention.
Figure 1A:
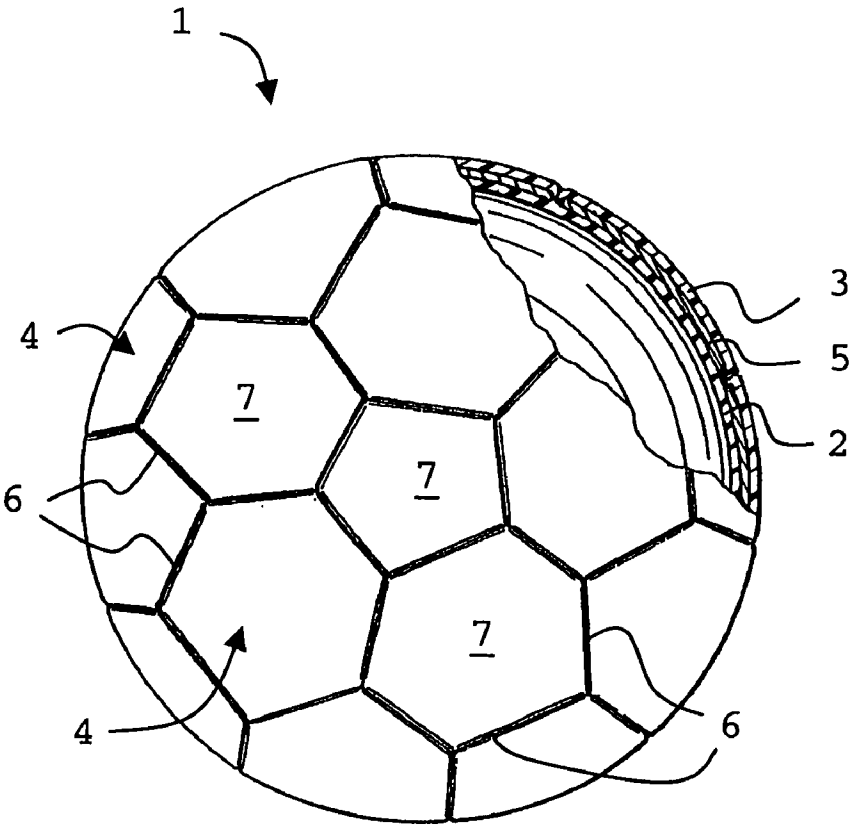

FIG. 1A shows a soccer ball 1 which is made up of three major components, namely an interior balloon or bladder 2, a cover 3 made of panel segments 4 of a synthetic material, such as PVC or polyurethane, and a liner 5 positioned between the bladder 2 and the cover 3. Optionally, other layers such as an intermediate foam layer (not shown) may be included between the liner 5 and cover 3. A soccer ball 1 for use in competitive play has a weight of 380-460 grams and a diameter of 21-23 cm.

More specifically, the bladder 2 has a spherical shape and is adapted to be filled with air. The preferred material for the bladder 2 is butyl rubber or latex. Other suitable materials include, but are not limited to, natural rubber, mixes of butyl rubber and natural rubber and polyurethane. The bladder 2 is of a size suitable to result in a soccer ball 1 having the diameter noted above.

The liner 5 preferably is formed of a relatively non-elastic material such as a woven fabric and/or polyester. The liner or liners 5 give the ball strength, structure and bounce. The liner 5 may have panel segments.

If an additional foam layer is used, this layer typically has a thickness of about 2 mm. Material for foam layers to be used in soccer balls is available from Interep S.A. (France).

Figure 6:
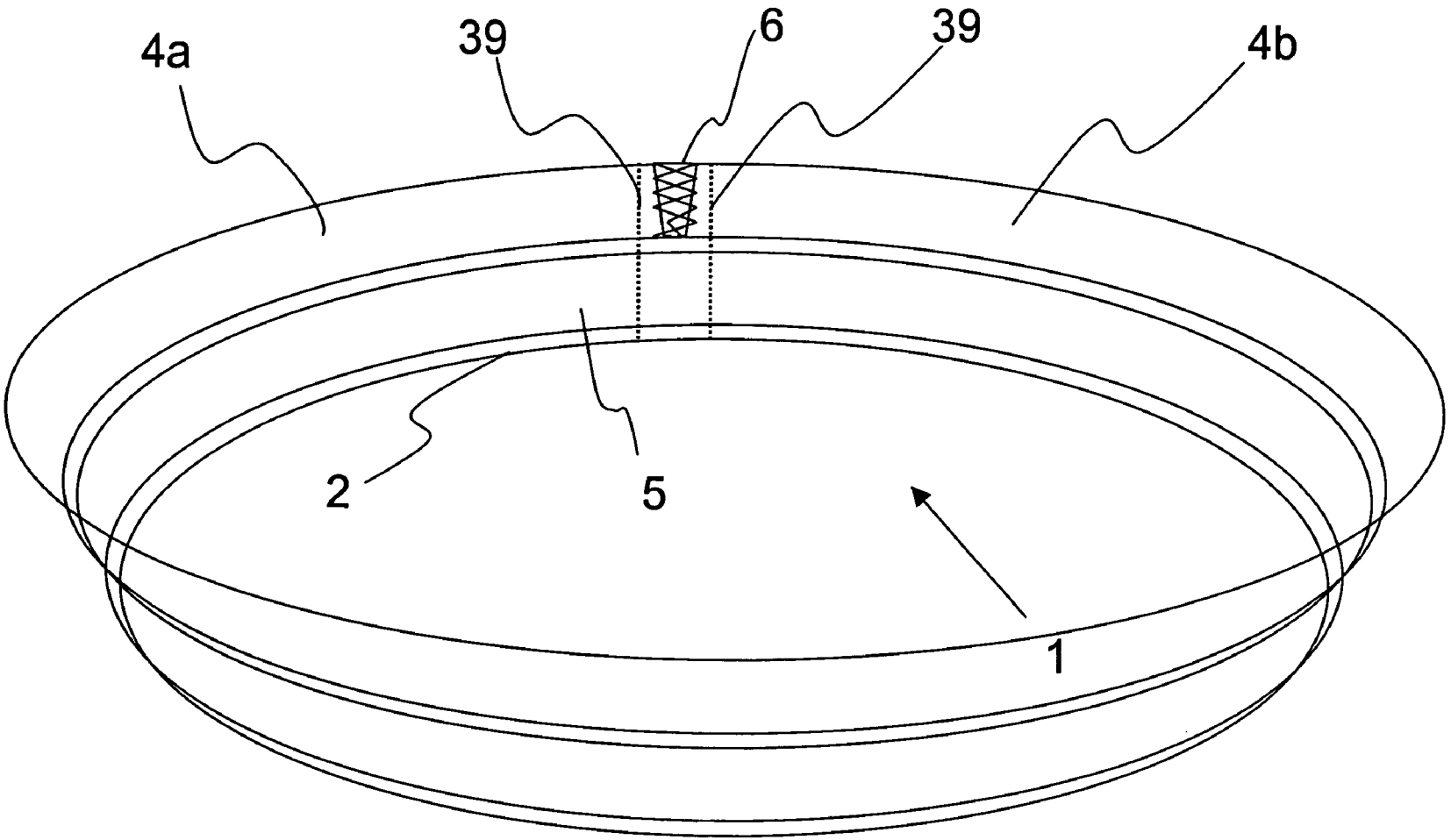
FIG. 6 shows a first set of connections connecting the edges of the panel segments to the core and a second set of connections connecting the panel segments to one another.

The cover 3 of the soccer ball is formed from 32 panels which are cut to an appropriate size, stitched to a liner 5 or liner panel and then stitched to each other by stitches 6. FIG. 6 illustrates such a ball which includes the core (shown as the bladder 2), the (optional) liner 5, and panel segments 4*a* and 4*b*. The edges of the panel segments 4*a* and 4*b* are connected to the core via the first set of connections 39 and the panel segments 4*a* and 4*b* are connected to one another via a second set of connections (shown as stitches 6). The ball illustrated in FIG. 6 may comprise e.g. a soccer ball, a baseball, a rugby ball, or any other kind of sports ball. High quality balls are stitched with a polyester or similar threads. Hand-sewn balls have tighter and stronger seams. Kevlar® reinforced polyester stitching is also used in some balls.

If used, the foam layer is sandwiched between the cover 3 and the liner 5 prior to stitching.

According to the present embodiment of the invention the ball 1 is provided with denim 7 on the outside of the panel segments 4. The denim fabric 7 is attached to the cover 3 solely by the stitches 6 that connect adjacent panel segments 4.

In order to improve the spherical shape of the sports ball 1, a twill 8, e.g. a fibre twill, may be provided around the bladder 2 as shown in FIG. 1B. The twill 8 maintains the spherical shape of the ball 1 during use. The spherical shape of the ball 1 prevents the woven fabric 7, attached only by the stitches 6, to get loose from the corresponding surface of the panel segment 4.

The ball 1 may be manufactured as follows. The first stage is to roll out the material used for the cover 3 of the ball 1. The cover 3 is usually made from several layers of synthetic foam-filled leaves which are glued together to produce a tough, smooth exterior. The leaves are cut into the exact amount needed to make one ball. The number of individual panels 4 required are then cut out, and holes are pre-punched in preparation for stitching. The stitching is performed by turning the ball inside out, so none of the stitches 6 show on the outside. Simultaneously, a denim fabric is attached to the cover 3 by the stitches 6. The stitched cover 3 is then reversed, the bladder 2 inserted and inflated.

Figure 2:
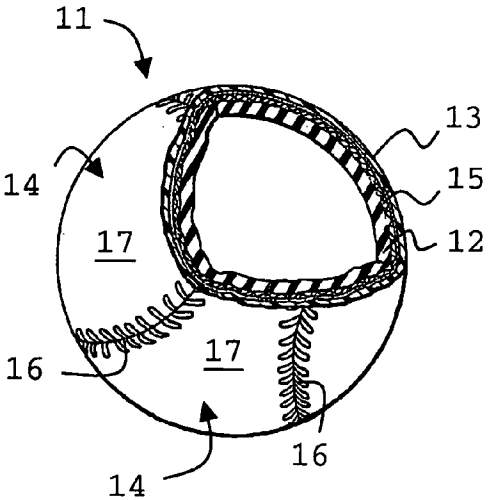
FIG. 2 shows a baseball with a partial cutaway according to an embodiment of the invention.

FIG. 2 shows a baseball 11 according to an embodiment of the invention. The baseball 11 according to the present embodiment of the invention comprises a resilient spherical core 12 tightly enclosed within a durable cover 13. Additional liners 15 may be provided. The core 12 is a spherical shell and may comprise two substantially identical semi-spherical shells suitably joined together into a unitary structure at the circumferential edges, respectively thereof, at a bonding seam (not shown). The core 12 is preferably formed from a soft flexible, waterproof material. Where the bonding between semi spherical shells is continuous, the interior of the core 12 may be pressurized by known means in relation to the ambient atmosphere in order to effect specific desired rebound characteristics of the baseball 11. Nevertheless, desirable performance characteristics are readily obtainable using a core 12 which is not pressurized.

The cover 13 comprises two panel segments 14 of a flat material joined one to another at the edges thereof by stitches 16 using some form of durable thread, such as nylon or vinyl. According to the invention, the outer face of the panel segments 14 is covered with a denim fabric 17. The denim fabric 17 is attached to the outer face by the stitches 16.

Figure 3:
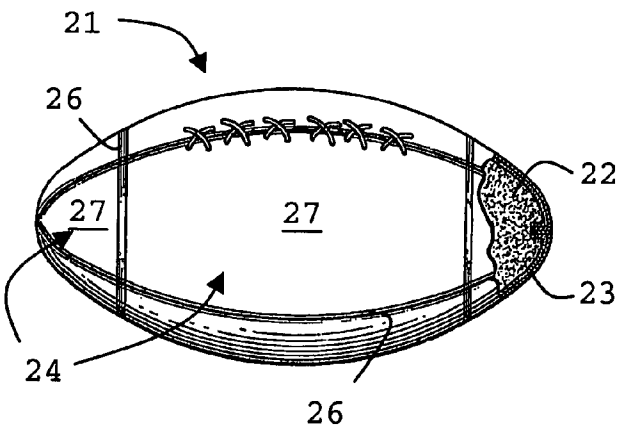
FIG. 3 shows a rugby ball with a partial cutaway according to an embodiment of the invention.

FIG. 3 shows a rugby ball 21 with a core 22 and a cover 23 comprising panel segments 24. Again the panels segments 24 are stitched together at stitches 26 and have attached the denim fabric 27 on the outer faces of the panels segments 24 by the stitches 26.

Figure 4:
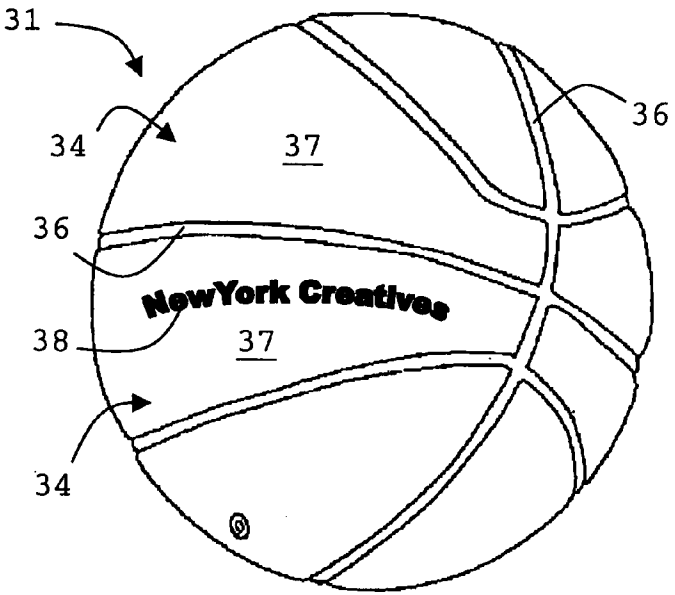
FIG. 4 shows a basketball according to an embodiment of the invention.

FIG. 4 shows a basketball 31 comprising panels segments 34 connected at thermally moulded joints 36. The panel segments 34 have attached the denim fabric 37 at the joints 36. A sign 38 is provided on the denim fabric 37.

Figure 5:
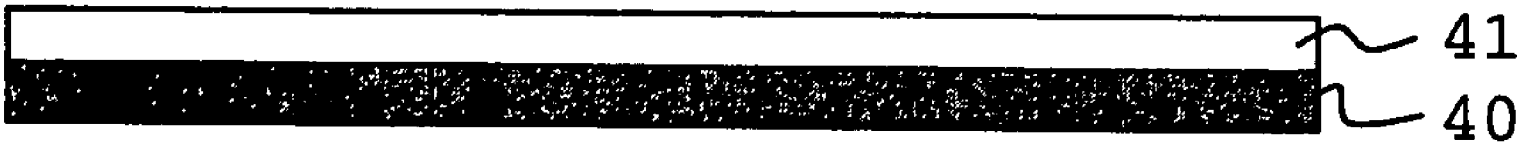
FIG. 5 shows a woven fabric provided with a transparent coating.

To prevent absorption of fluids, such as water, each of the above-described balls may comprise a transparent coating provided over the woven fabric. FIG. 5 shows a denim layer 40, provided with at least one side with a transparent coating 41. Such a transparent coating 41 may e.g. include a transparent rubber coating, a transparent polyvinyl chloride coating (PVC) coating and/or another type of transparent vinyl coating. It should be acknowledged that the woven fabric 40 provided with a transparent coating 41 may also be applied for other articles than the sports ball of the invention, including a ball with a denim cover, an umbrella of a woven fabric, a cover for a seat with a denim layer provided with a transparent coating, or a car roof of e.g. a convertible.

The transparent coating 41 may e.g. be provided on the woven fabric 40 by first wiping the coating over the woven fabric and subsequently heating the combination of the woven fabric 40 and the transparent coating 41 in a furnace at a temperature between 80-160° C.

The invention claimed is:

1. A sports ball comprising a core and a cover formed from a plurality of panel segments, one or more of the panel segments having an outer face covered with a woven fabric, the woven fabric constituting an outermost face of the sports ball where the woven fabric covers the outer face of the one or more of the panel segments, wherein edges of the panel segments are connected to the core via at least one of stitches or thermal moulding and the woven fabric is attached to the outer face of the one or more panel segments only at the edges, the woven fabric is otherwise not adhesively attached to the outer face of the one or more panel segments, and the core is an integral layer at the edges.

2. The sports ball according to claim 1, further comprising a bladder with a twill provided around the bladder.

3. The sports ball according to claim 1, wherein the woven fabric on at least one of the one or more panel segments comprises one or more visible signs.

4. The sports ball according to claim 1, wherein the sports ball is one of a soccer ball, a baseball or a rugby ball.

5. A method for manufacturing a sports ball according claim 1, the method comprising sewing the one or more panel segments together at the edges substantially simultaneously with attaching the woven fabric at the edges.

6. The method according to claim 5, wherein the sewing is by hand sewing.

7. A method for manufacturing a sports ball according to claim 1, the method comprising thermally moulding the one or more panel segments together at the edges substantially simultaneously with attaching the woven fabric at the edges.

8. A sports ball according to claim 1, wherein the woven fabric includes a transparent coating.

9. The sports ball according to claim 1, wherein the woven fabric comprises at least one of denim or canvas.

10. The sports ball according to claim 1, further comprising one of a liner or a liner panel disposed between the core and the cover, wherein the edges are connected to the core by connecting the edges to the one of the liner or the liner panel.

11. The sports ball according to claim 1, wherein the stitches or the thermal moulding comprises a first set of connections connecting the edges to the core, and the one or more panel segments are connected to one another via a second set of connections, the second set of connections being different than the first set of connections.

12. The sports ball according to claim 1, wherein the core extends continuously at the edges.

13. The sports ball according to claim 1, wherein the core is relatively non-elastic.

14. The sports ball according to claim 1, wherein the core has panel segments.

* * * * *